United States Patent [19]

Momozhane

[11] 4,253,001

[45] Feb. 24, 1981

[54] SNAP ACTION SWITCH

[75] Inventor: Hiroshi Momozhane, Kurayoshi, Japan

[73] Assignee: Omron Tateisi Electronics Co., Nagaokakyo, Japan

[21] Appl. No.: 52,270

[22] Filed: Jun. 26, 1979

[30] Foreign Application Priority Data

Jul. 14, 1978 [JP] Japan ..... 53-97201

[51] Int. Cl.[3] ..... H01H 13/28; H01H 13/36

[52] U.S. Cl. ..... 200/67 B; 200/67 D

[58] Field of Search ..... 200/67 B, 67 D, 67 R, 200/83 P

[56] References Cited

U.S. PATENT DOCUMENTS

| | | | |
|---|---|---|---|
| 2,486,033 | 10/1949 | Kaminky | 200/67 D |
| 2,487,374 | 11/1949 | Riche et al. | 200/67 B |
| 2,510,021 | 5/1950 | Kaminky | 200/67 D |
| 2,810,030 | 10/1957 | Ball | 200/67 D |
| 3,349,202 | 10/1967 | Beer | 200/67 B |
| 3,432,632 | 3/1969 | Schonke | 200/67 B |
| 3,648,004 | 3/1972 | Williams | 200/67 D |
| 3,838,237 | 9/1974 | Hoshioka | 200/67 D |
| 3,965,313 | 6/1976 | Olson | 200/67 D |
| 3,996,435 | 12/1976 | King | 200/67 B |

FOREIGN PATENT DOCUMENTS

| | | | |
|---|---|---|---|
| 1392709 | 4/1975 | United Kingdom | 200/67 B |

*Primary Examiner*—John W. Shepperd

*Attorney, Agent, or Firm*—Stevens, Davis, Miller & Mosher

[57] ABSTRACT

A snap action switch having an over-centering mechanism and a housing for enclosing the mechanism, the mechanism including an actuating button, a first and a second fixed terminal bearing a first and a second contact, respectively, both the first and second terminals being secured to end wall of the housing, a stationary terminal secured to the housing in spaced apart relation to the end wall, a switch blade carrying a movable contact, the blade pivotally connected at one end to the stationary terminal, an actuator lever having a first end adapted to engage said actuating button and a second end pivotally supported by the end wall of the housing, and a coil spring connected to one end to the blade and at an other end to the first end of actuator lever, characterized in that the actuator lever has a medial portion which is disposed on an opposite side of the first fixed contact with respect to the second fixed contact, and is pivotally supported at the second end thereof by an inner portion of the end wall between the first and second fixed terminals.

6 Claims, 8 Drawing Figures

SNAP ACTION SWITCH

BRIEF SUMMARY OF THE INVENTION

The present invention relates to a snap action switch utilizing an over-centering mechanism, and more particularly to an improved snap action switch in which an actuator lever is positioned out of the air space between a pair of fixed contacts.

Heretofore, a snap action switch in which an actuator lever 1 is positioned within a cavity of the switch as shown in FIG. 1 is well known as a light actuation force type switch. Such a snap action switch is also shown in Cherry et al. U.S. Pat. No. 3,405,243, issued Oct. 8, 1968. Such actuator lever 1 is disposed between a pair of spaced apart fixed terminals 2*a* and 2*b* each having a fixed contact, pivotally supported at a base end 1*a* by a groove formed on an inner surface of an end wall of a case 3, and is adapted to engage an actuating button 4 at its top end 1*b*. A coil spring 6 is connected between the top end 1*b* of the actuator lever and a movable switch blade 5. Such lever 1 is also so disposed as to restrict the expansion of spring 6 to a predetermined small stroke, so that such a snap action switch can be actuated by a relatively light actuation force. Since the lever 1 is disposed between the fixed terminals, however, such a switch has the disadvantage that the gap between the fixed contact and the actuator lever is necessarily too narrow to ensure an adequate dielectric strength for the switch. Moreover, on account of the interposition of the actuator lever, foreign matter such as the black powder or metal powder which is produced by the arc discharge induced on every switching action tends to deposit around the base end 1*a* of the lever and thereby to destroy the insulation relative to the creepage distance between fixed terminals 2*a* and 2*b*, resulting in a short-circuit of the contacts. To overcome these disadvantages, it might be contemplated to locate the actuator lever 1 outside of the air space between fixed terminals so as to ensure sufficient creepage distance and gap, but such an arrangement would result simply in a switch not responsive enough to a light actuation force.

It is, therefore, a primary object of the present invention to provide a snap action switch having a high dielectric strength and a sufficient insulation which can be switched on and off with a light actuation force.

It is a further object of the present invention to provide a snap action switch in which an actuator lever is pivotally supported by an inner portion of one wall of a housing and is positioned around a fixed contact or terminal to have a sufficient gap and a creepage distance therebetween.

It is another object of the present invention to provide a snap action switch which is responsive to a light actuation force and, yet, which provides a sufficient contact pressure.

It is another object of the present invention to provide a snap action switch having a pair of shallow circular recesses for pivotally supporting a base end of an actuator lever.

According to one aspect of the present invention, there is provided a snap action switch having an over-centering mechanism and a housing consisting of a case and a cover which provide an internal cavity for housing the over-centering mechanism, the over-centering mechanism including an actuating button which is movably supported by the housing for directing an external actuating force into the mechanism within the cavity, a first and a second fixed terminal bearing a first and a second fixed contact, respectively, both said first and second terminals being secured to one wall of said housing, a stationary member secured to the housing in spaced-apart relation to said one wall thereof, a tension member pivotally connected at one end to the stationary member, an actuator lever having a first end adapted to engage said actuating button and a second end pivotally supported by said one wall of the housing, and a compression member connected at one end to said tension member and at an other end to said first end of actuator lever, characterized in that said actuator lever has a medial portion which is disposed on an opposite side of said first fixed contact with respect to said second fixed contact and in spaced apart relation with the second fixed terminal, and a cross portion disposed across said second fixed terminal in a spaced relationship therewith, said lever being pivotally supported at said second end thereof by an inner portion of said one wall between said first and second terminals so that the lever is held at a sufficient distance from the first and second terminals.

BRIEF DESCRIPTION OF DRAWINGS

Other objects as well as the numerous advantages of the snap action switch according to the present invention will become apparent from the following detailed description and the accompanying drawings, in which.

DETAILED DESCRIPTION

Figure 2:
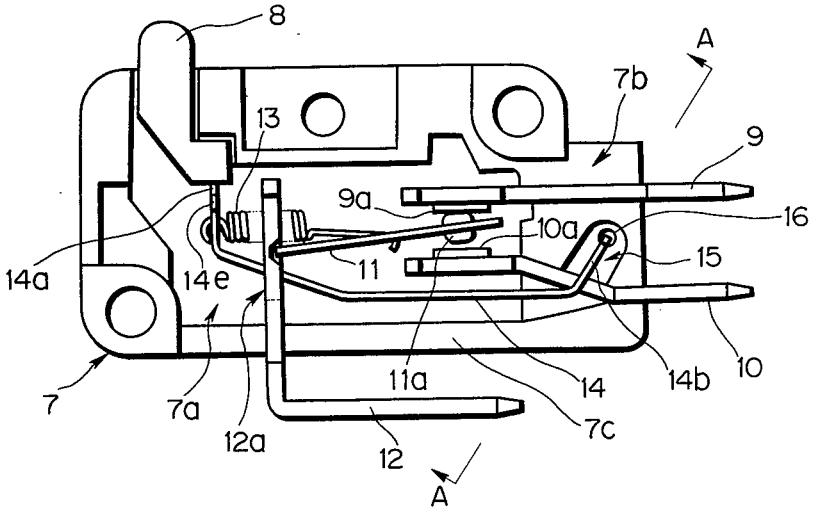
FIG. 2 is a side elevational view showing a snap action switch, with its cover removed, according to one embodiment of the present invention.

Referring, now, to FIG. 2, there is shown a snap action switch as one embodiment of the present invention, in which a plastic case 7 is hollowed out to provide an internal cavity 7*a* for housing an internal over-centering mechanism. An actuating button 8 is slidably mounted on the case 7 for directing an external actuating force into the internal over-centering mechanism. The over-centering mechanism comprises a pair of spaced apart fixed contact-bearing terminals 9 and 10 having a pair of fixed contacts 9*a* and 10*a*, respectively, a movable switch blade 11 carrying a contact 11*a* which is movable between the fixed contacts 9*a* and 10*a*, a fixed terminal 12 for pivotally supporting the movable switch blade 11, an actuator lever 14 engaging at a first end 14*a* thereof the actuating button and pivotally supported at a second end 12*b* thereof by an end wall 7*b* of the case 7, and a coil spring 13 connected at one end thereof to a medial portion of the blade 11 and at the other end thterof to the first end 14*a*. The fixed terminal 12 has an opening 12*a*, both the spring 13 and the lever 14 extending therethrough. The lever 14 extends from the button 8 toward and, then, along but apart from the bottom wall 7*c* of the case 7, with the medial portion thereof being positioned below the second fixed terminal 10 and the base portion 14*b* thereof passing across the terminal 10 in a spaced-apart relation therewith. The base 14*b* of the lever 14 is pivotally supported by a groove 15 formed in an inner portion of the end wall 7*b*. The blade 11 is a tension member for tensing the spring 13 toward its connection to the blade 11, and the spring 13 is a compression member which is predisposed to reduce the distance between its connections to the blade 11 and the free end 14*a* of the lever 14, so that the lever 14 is urged toward the pivot point of the base 14*b*.

Figure 4:
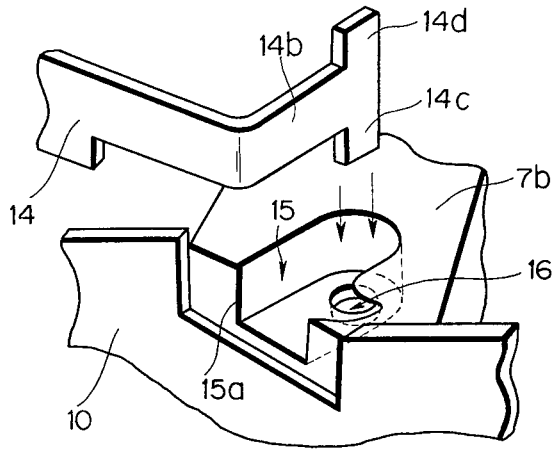
FIG. 4 is a perspective view showing the internal parts to illustrate the base end of an actuator lever of the switch of FIG. 1.

In FIG. 4 there is shown in detail the groove 15 for supporting the blade 14. The base 14*b* which is bent relative to the logitudinal axis of the lever 14 has a pair of outwardly extending tongues 14*c* and 14*d* which serve as the axis of rotation of the lever. The groove 15 formed in the inner portion of the end wall 7*b* further has a shallow circular recess 16 having a depth sufficient to engage only the end of tongue 14*c*. The depth of the recess 16 is sufficient to prevent the base 14*b* from being disengaged but is small enough to ensure only a minimum of friction by the pivotal movement. The diameter of the recess 16 is substantially equal to the width of the tongue 14*c* so that the recess 16 may support the tongue 14*c* wihout rattling. The groove 15 has a sufficient depth 15*a* for enclosing the base 14*b* and a sufficient width not to interfere with the pivotal movement of the lever 14 at the base 14*b*.

Figure 3:
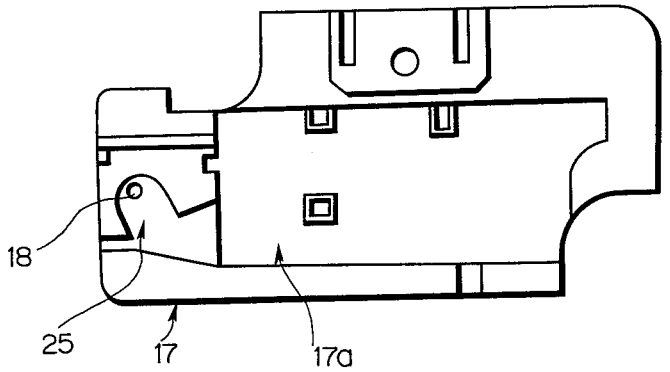
FIG. 3 is a side elevational view of the cover of the switch illustrated in FIG. 2.
Figure 5:
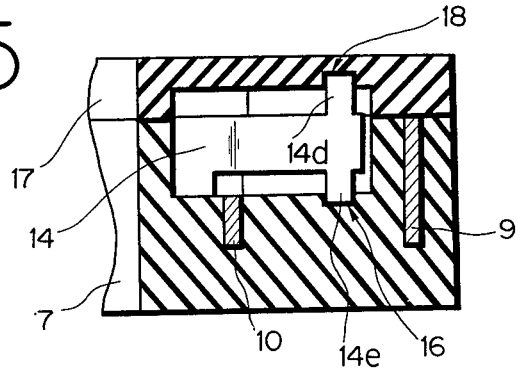
FIG. 5 is a fragmentary sectional view of the switch taken along the line A—A of FIG. 1.

In FIG. 3 there is shown a cover 17 which is adapted to fit with the case 7 when the case and the cover are joined together to form a complete housing. The cover 17 also has a groove 25 and a shallow recess 18 for supporting the base 14*b* of the lever 14, the shallow recess 18 being similar to the recess 16. As shown in FIG. 5, when the case 7 and the cover 17 are joined together, the two shallow recesses 16 and 18 engage the tongues 14*c* and 14*d*, respectively, without a substantial clearance, so that the lever 14 pivotally moves without rattling sideways.

Figure 1:
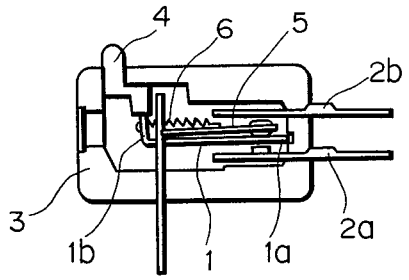
FIG. 1 (PRIOR ART)
FIG. 1 is a side elevational view of a conventional snap action switch with its cover removed.

In the present embodiment, as an external force is applied to the actuating button 8, it will move in a vertical path as shown in FIG. 1, causing a corresponding pivotal movement of the actuator lever 14 about its pivotal connection to the recess 16 (FIG. 2). As the coil spring 13 moves into a lower position, it will pass the over-centering line of the blade 11 causing the same to move in a snap action from one contact (9*a*) to another (10*a*). Upon removal of the external force acting on the button 8, the parts of the over-centering mechanism will return to their original positions shown in FIG. 1.

The actuator lever 14, located within the internal cavity of the switch housing, is extending around the fixed terminals 9 and 10 in sufficiently spaced apart relationship with respect thereto so that the snap action switch has sufficient gap and creepage distance between and among the movable contact 11*a*, fixed contacts 9*a* and 10*a*, and other parts electrically connected thereto, with the result that the switch may provide excellent characteristics with respect to electrical insulation. Since, in this arrangement, the actuator lever 14 is so elongated that the stroke of coil spring 13 required for completing the snap action movement of the switch is reduced and the operating force required to effect the switching actuation of the switch is also reduced. By the arrangement of this particular embodiment, an operating force less than 10 gwt. is sufficient to effect the switching actuation. In spite of such a light actuating force, since the shallow recesses 16 and 18 are disposed slightly offset toward the fixed terminal 10 from the centerline between terminals 9 and 10, the switch provides a sufficient contact pressure between contacts 11*a* and 9*a*, or between 11*a* and 10*a*. If the recesses 16 and 18 are positioned farther away from terminal 10, upon removal of the external actuating force the switching mechanism is difficult to return to its original position. Or, if the recesses 16 and 18 are positioned closer to, or beyond, the terminal 10, the switch requires a much greater actuating force for the snap action movement.

In assembling, the groove 15 proves useful in that the actuator lever 14 may be temporarily supported therein. Thus, along with a projecting portion 14*e* of lever 14, it facilitates assembling of internal parts into the housing. (See FIG. 6) Especially since the lever 14 is installed under the terminal 10, the assembling work is considerably facilitated as compared with the prior art switch of FIG. 1. After assembling, should it happen that the tongue 14*c* or 14*d* is accidentally disengaged from the recess 16 or 18, the grooves 15 and 25 restrict the displacement of spring 13 from its effective position, thus permitting the switch still to perform the desired snap action movement, though such movement is not completely wholesome.

Figure 6:
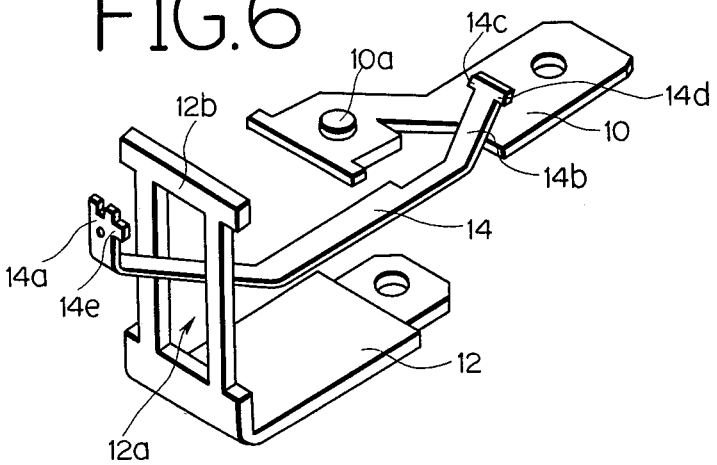
FIG. 6 is a perspective view showing several internal parts of the switch of FIG. 1 to illustrate the internal arrangement thereof.

As seen in FIGS. 4 and 6, the terminal 10 and lever 14 each has a cut portion to provide a sufficient gap therebetween. Alternatively, for a further complete insulation, the base 14*b* including the tongues 14*c* and 14*d* may be made of insulating material instead of metal.

The opening 12*a* through the stationary member 12 is an elongated window as seen in FIG. 6, but alternatively may be a cut portion not having a top frame member 12*b*.

Figure 7:
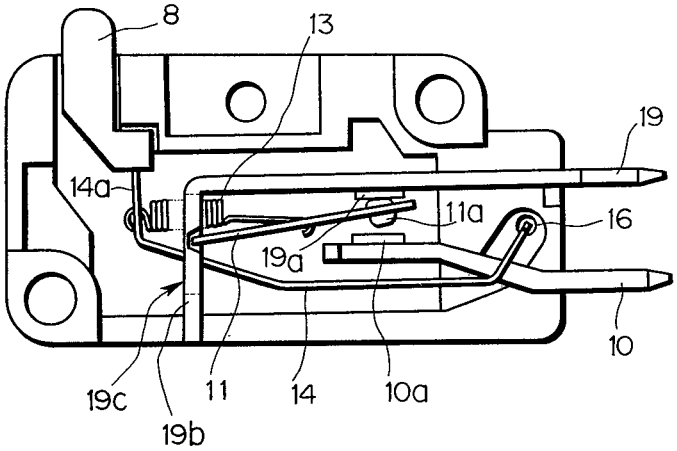
FIG. 7 is a side elevational view showing a snap action switch, with its cover removed, according to another embodiment of the present invention

In FIG. 7 there is shown another snap action switch embodying the present invention in which a stationary member 19*b* which supports a switch blade 11 and is pierced by actuator lever 14 and spring 13 through its opening 19*c* is an extension of fixed terminal 19.

Figure 8:
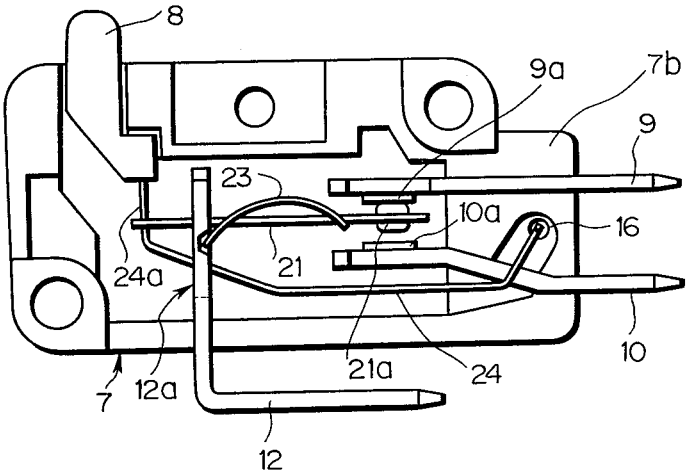
FIG. 8 is a side elevational view showing a snap action switch, with the cover removed, according to still another embodiment of the present invention.

In FIG. 8 there is shown still another switch embodying the present invention, in which a leaf spring 23 is connected at one end thereof to the fixed terminal 12 and at the other end to a switch blade 21 carrying a movable contact 21*a*. The spring 23 serves as a tension member for tensing the blade 21 toward the contact 21*a*, and the blade 21 serves as a compression member which is predisposed to reduce the distance between its connections to actuator lever 24 and spring 23, so that the lever 24 is urged toward the shallow recess 16 for pivotally supporting the lever 24. This snap action switch is not only responsive to a light actuating force but offers an excellent insulation characteristic. Moreover, because a leaf spring is employed, the switch has the advantage of dynamic accuracy over the coil spring type switch shown in FIG. 1.

In the foregoing embodiments, the actuator lever is positioned under the lower positioned fixed terminal 10 at the medial portion thereof. It will be understood, however, that the lever may be modified to be positioned above the upper fixed terminal 9 or 19 at its medial portion and at the base end of the lever pivotally supported by the shallow recesses between the fixed terminals 10 and 9 or 19.

It should be understood that the above description is merely illustrative of the present invention and that many changes and modifications may be made by those skilled in the art without departing from the scope of the appended claims.

What is claimed is:

1. A snap action switch having an over-centering mechanism and a housing consisting of a case and a cover which provide an internal cavity for housing the over-centering mechanism, the over-centering mechanism including an actuating button which is movably supported by the housing for directing an external actuating force into the mechanism within the cavity, a first and a second fixed terminal bearing a first and a second fixed contact, respectively, both said first and second terminals being secured to one wall of said housing, a stationary member secured to the housing in spaced-apart relation to said one wall thereof, a tension member pivotally connected at one end to the stationary member, an actuator lever having a first end adapted to engage said actuating button and a second end pivotally supported by said one wall of the housing, and a compression member connected at one end to said tension member and at another end to said first end of actuator lever, characterized in that said actuator lever has a medial portion which is disposed on an opposite side of said first fixed contact with respect to said second fixed contact and in spaced apart relation with the second fixed terminal, and a cross portion disposed across said second fixed terminal in a spaced relationship therewith, said lever being pivotally supported at said second end thereof by an inner portion of said one wall between said first and second terminals so that the lever is held at a sufficient distance from the first and second terminals.

2. A snap action switch according to claim 1, wherein said second end of actuator lever has an axis of rotation which is disposed slightly offset from the centerline between said first and second fixed terminals toward said second fixed terminal.

3. A snap action switch according to claim 1, wherein said second end of actuator lever has a pair of outwardly extending tongues which serve as an axis of rotation, said case and cover at said one wall respectively have a groove having a sufficient width to allow said lever to freely move, said groove having a shallow circular recess formed in the bottom wall thereof, said recess having a diameter almost equal to the corresponding width of said tongues, only the edges of said tongues respectively engaging said corresponding recesses to allow said lever to smoothly move without rattling.

4. A snap action switch according to claim 1, wherein said second fixed terminal and said actuator lever each has a cutout portion where they cross each other.

5. A snap action switch according to claim 1, wherein said actuator lever is partially made of non-conductive material where it confronts said second fixed terminal.

6. A snap action switch according to claim 1, wherein said stationary member has an elongated opening, said compression member and said actuator lever extending through said elongated opening.

* * * * *